US006229103B1

(12) United States Patent
Yamamoto et al.

(10) Patent No.: US 6,229,103 B1
(45) **Date of Patent: *May 8, 2001**

(54) ELECTRONIC COMPONENT WITH BUILT-IN PUSH SWITCH DRIVEN BY ROTARY AND PUSHING OPERATION OF AN OPERATING KNOB

(75) Inventors: Tamotsu Yamamoto, Ashiya; Shigeru Yokoji, Kadoma; Hiroto Inoue, Uji; Hiroshi Matsui, Hirakata; Keiji Kaizaki, Neyagawa; Koji Tamano, Osaka, all of (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/011,480

(22) PCT Filed: Jul. 1, 1996

(86) PCT No.: PCT/JP96/01821

§ 371 Date: Aug. 6, 1998

§ 102(e) Date: Aug. 6, 1998

(87) PCT Pub. No.: WO97/08720

PCT Pub. Date: Mar. 6, 1997

(30) Foreign Application Priority Data

Aug. 23, 1995 (JP) ..... 7-214391
Mar. 27, 1996 (JP) ..... 8-072702

(51) Int. Cl.[7] ..... H01H 25/00

(52) U.S. Cl. ..... 200/4; 200/517; 200/305

(58) Field of Search ..... 200/4, 18, 19.02, 200/19.03, 406, 517, 547, 551, 332, 332.1, 305; 29/622

(56) References Cited

U.S. PATENT DOCUMENTS 3,459,903 * 8/1969 Richardson ..... 200/19.03 X
3,772,484 11/1973 Roeser .
4,518,832 5/1985 Geremia .

(List continued on next page.)

FOREIGN PATENT DOCUMENTS 0531829 3/1993 (EP) .
63-257140 10/1988 (JP) .
2-52236 4/1990 (JP) .
3-69878 7/1991 (JP) .
5-55431 7/1993 (JP) .
8-203387 8/1996 (JP) .

*Primary Examiner*—Renee Luebke
(74) *Attorney, Agent, or Firm*—McDermott, Will & Emery

(57) ABSTRACT

An operation type electronic component which is used for a remote controller of various electronic equipment and portable electronic equipment and is equipped with a push switch driven by the rotating and push operation of an operation knob. The component can be reduced in size and grounded by a simple construction and can be grounded by merely fitting. A dome-like movable contact (23E) is put on fixed contacts (23A, 23B) disposed on a fitting substrate (22) to form a switch unit (23). An L-shaped actuator is interposed between this switch unit (23) and a driving body (21) so that the driving body (21) returns to the original state after the push operation of an operation knob (6) by the elastic operation force of the dome-like movable contact point (23E)of the switch unit (23). Further, a metal plate (25) equipped integrally with a live current portion (10) and a conductor of an earth portion (26) is fixed by insert-molding to the resin fitting substrate (22) and is electrically isolated so as to interpose a lightning conductor portion (26A) of the earth portion (26) between the live current portion (10) and the operation knob (6). According to this constitution, the number of constituent components can be reduced, the overall size can be reduced, too, and static electricity occurring in the operation knob (6) can be always conducted to the earth.

10 Claims, 13 Drawing Sheets

U.S. PATENT DOCUMENTS

| | | | | |
|---|---|---|---|---|
| 4,553,009 | * | 11/1985 | Van Zeeland et al. | 200/517 |
| 4,803,316 | * | 2/1989 | Hayashi et al. | 200/406 |
| 4,814,566 | | 3/1989 | Sigl . | |
| 4,833,932 | | 5/1989 | Rogers . | |
| 4,843,197 | | 6/1989 | Kojima et al. . | |
| 4,990,731 | * | 2/1991 | Wu et al. | 200/517 X |
| 5,076,426 | * | 12/1991 | Thomas | 29/622 X |
| 5,180,050 | | 1/1993 | Rada et al. . | |
| 5,335,137 | | 8/1994 | English et al. . | |
| 5,430,262 | | 7/1995 | Matsui et al. . | |
| 5,488,210 | | 1/1996 | Shigetaka et al. . | |
| 5,613,600 | | 3/1997 | Yokoji et al. . | |

* cited by examiner

ELECTRONIC COMPONENT WITH BUILT-IN PUSH SWITCH DRIVEN BY ROTARY AND PUSHING OPERATION OF AN OPERATING KNOB

FIELD OF TECHNOLOGY

The present invention relates to an operation type electronic component with built-in push switch driven by rotating operation and push operation of an operating knob, which operation type electronic component being a component mainly used in remote controllers of various electronic appliances or in portable electronic devices.

BACKGROUND TECHNOLOGIES

A rotary encoder with built-in push switch, which is an embodiment of a prior art operation type electronic component with push switch, is described hereunder referring to FIGS. 9 through 13.

A prior art rotary encoder with built-in push switch comprises, as shown in FIG. 9 (cross sectional view) and FIG. 10 (partially cutaway top view), a movable member 1 affixed movable to a base board 2 in holding part 1C, a rotary contact wheel 3 attached revolvable on the movable member 1 and disposed at the middle part of the base board 2, and a switch 4 disposed at a rear part of base board 2 (at the right in FIGS. 9–10).

The rotary contact wheel 3 is provided at the bottom surface with contact plates 3A disposed in a radial arrangement for accepting contacts from elastic contact reeds 5 of the base board 2, and held revolvable at the central hole 3B by a pillar 1A of the movable member 1, with the top covered with an operating knob 6 that rotates together.

As shown in a perspective view of FIG. 11, the base board 2 comprises a hole 2A provided in a side part for holding the movable member 1 movable, a hollow 2C having a stop wall 2B for fixing the switch 4, elastic contact reeds 5 for generating electric signal by having contact with the bottom surface of rotary contact wheel 3, and terminals 7 for taking the generated electric signal out.

A coil spring 8, which is positioned by an extrusion 2D located on the base board 2 at a rear part, pushes a side of the movable member 1 in horizontal direction so that push rod 1B of the movable member 1 is usually kept off the switch 4. Switch 4 is, as shown in FIG. 9, fixed in the hollow 2C of base board 2 with the rear end touching to the stop wall 2B, and a button 4A facing to the push rod 1B of movable member 1.

The operation of the above prior art rotary encoder having push switch is described in the following.

The rotary contact wheel 3 rotates with the pillar 1A of movable member 1 as the axis when the knob 6 attached on the rotary contact wheel 3 is rotated by a force given in tangential direction indicated with an arrow F in FIG. 10. The radial contact plates 3A disposed on the bottom surface of rotary contact wheel 3 slide on the elastic contact reeds 5 of base board 2, and pulse signals are generated. The pulse signals are outputted through the terminals 7, thus it works as a rotary encoder.

While the operating knob 6 is being rotated, a pushing force is also given to the knob, but the spring force of said twisted coil spring 8 prevents the push rod 1B of movable member 1 from pushing the button 4A of switch 4.

When the operating knob 6 is pressed in the direction of an arrow G in FIG. 10 with more force than the force due to the coil spring 8, the entire part of the movable member 1 including the rotary contact wheel 3 is moved to the direction of an arrow H with the holding part 1C of movable member 1, or a hole 2A of the base board 2, as the axis of movement, causing the push rod 1B of movable member 1 push the button 4A to actuate the switch 4. As soon as the force given to the knob 6 is withdrawn, the force of twisted coil spring 8 pushes the movable member 1 back to the original position.

The above described prior art rotary encoder having push switch employs an independent completed switch for the switch 4 that works on a push of the operating knob 6, and comprises the coil spring 8 disposed at a rear part of the base board 2 for preventing the push rod 1B of movable member 1 from pushing the switch 4 while the operating knob 6 is being rotated, as well as for restoring the movable member 1 to the original position when the pushing operation on the operating knob 6 is finished. These result in a higher cost and an increased body size of a rotary encoder having push switch.

In the general trends towards the more compact and lower price of electronic appliances, those electronic components to be incorporated in such appliances are likewise requested to be compact yet have advanced functions, coming in low price. A means to meet the requirement is to make the components available on an automatic production line. A popular solution is introduction of an insert-shaping technique, wherein contact points, terminals and other conductive members are formed on a hoop of metal sheet to be inserted into a resin molded base board, for the later assembly on an automatic assembly machine.

Now in the following, a method of manufacturing a base board containing contacts, terminals and other conductive members is described with reference to FIG. 12, using the above mentioned prior art rotary encoder having push switch as the vehicle.

FIG. 12 illustrates a metal sheet hoop showing a set of conductive members formed on the metal sheet and a resin molded base board with the set of conductive members inserted therein. Numeral 9 denotes an electro-conductive metal sheet hoop provided with frame alley 9A, and 10 conductive members stamped in flat sheet form with each of the members remaining connected with the frame alley 9A at connecting sections 9B. Numeral 2 denotes a resin molded base board with the conductive members 10 inserted therein.

In the next step, the base board 2 undergoes a cutting at the joints 10A of conductive members 10, and then the conductive members 10 are formed to become elastic contact reeds 5. Then, the sections 9B connecting with the frame alley 9A are cut at cutting lines 9C, and the terminals 7 are bent downward to complete a base board 2 as shown in FIG. 11.

The cut surface 11 of electro-conductive metal sheet 9 is exposed out of the surface of base board 2 in the above prior art method. When a rotary encoder 12 having push switch 12 assembled with the above base board 2 is mounted on a circuit board 14 with a part of the operating knob 6 extruding out of outer casing 13, and the cut surface is positioned at a vicinity of the operating knob 6, a static electricity generated while the operating knob 6 is rotated with a finger discharges to the cut surface 11. The discharge affects the signals to be outputted from a rotary encoder having push switch 12, producing possible causes of erroneous operation of an apparatus.

In prior art methods, therefore, the cut surface 11 had to be covered with a separate metal board 15 electrically coupled with a ground sector 16 of apparatus by means of soldering etc., whenever there is a possibility of the electrostatic problem. This is a substantial drawback that results in an extra parts count and additional assembly steps.

DISCLOSURE OF THE INVENTION

The present invention is intended to solve the above described problems the prior arts had, and to present an operation type electronic component which has a simple structure enabling the reduction of the total dimensions and cost, wherein the grounding work is completed at a same time with a mounting work.

An operation type electronic component according to the present invention comprises a switch which is constituted by providing a dome shape moving contact point on a fixed contact point prepared on base board, and an L-shaped actuator disposed between the switch and a movable member; wherein the elastic force of the dome shape moving contact point is utilized to prevent the movable member from actuating the switch while an operating knob is being rotated, the elastic force is also used to return the movable member to the original position after a push operation to the knob is finished. Further, according to the present invention, the conductive members and the grounding member which are provided on a same metal sheet are fixed in a resin mold base board by means of an insert-shaping technique, and then the electrical coupling between the conductive members and the grounding member is broken; thus the grounding member is placed between the conductive members and the knob.

With the above described constitution, the total number of constituent parts including the parts constituting the switch is reduced, which enables the reduction of cost and the overall size of an operation type electronic component, furthermore the static electricity generated at the knob is always discharged to a nearest electro-conductive substance, viz. the grounding member.

DESCRIPTION OF THE PREFERRED EMBODIMENTS

Figure 1:
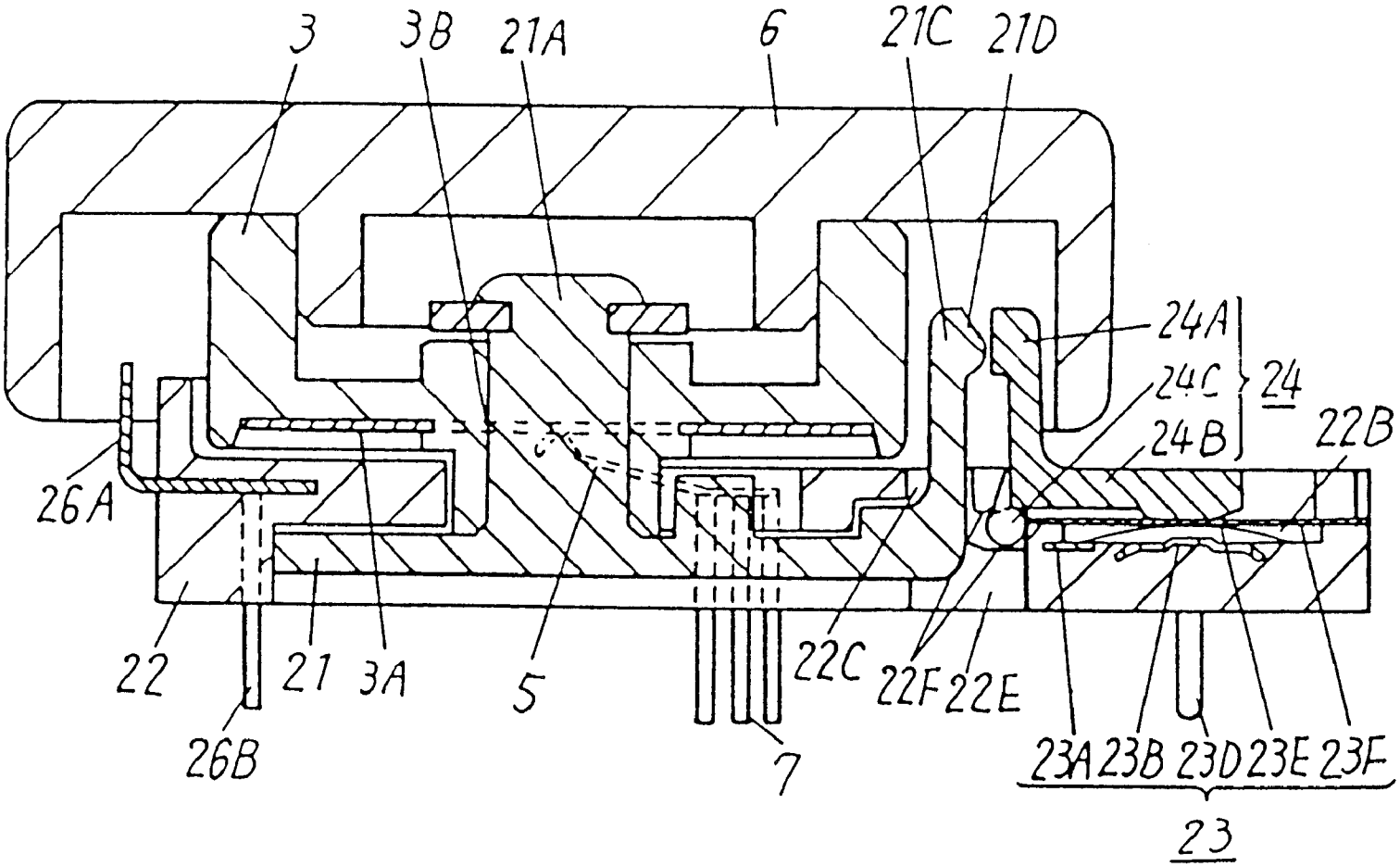
FIG. 1 is a cross sectional view showing a rotary encoder having push switch according to an embodiment of an operation type electronic component of the present invention, FIG. 2 a partially cutaway top view of the above rotary encoder, FIG. 3 a perspective view of the key part of the above rotary encoder, viz. base board, FIG. 4 a perspective view of the key part of the above rotary encoder, viz. L-shaped actuator, FIG. 5 a cross sectional view of the key part of the above rotary encoder showing how the L-shaped actuator is attached to the base board, FIG. 6 a cross sectional view of the above rotary encoder showing when the knob is being pushed, FIG. 7 a top view of metal sheet hoop showing the conductive members and grounding member formed on the hoop, and these members after insert-molded in a resin mold base board, FIG. 8 a cross sectional side view of the above rotary encoder having push switch mounted in a casing.

An operation type electronic component according to an embodiment of the present invention is described below using a rotary encoder having push switch as the vehicle, referring to FIG. 1 through FIG. 8. In the drawings, those constituent parts having the same functions as those of the above described prior art are given with the same symbols, and explanation to which is omitted.

Figure 2:
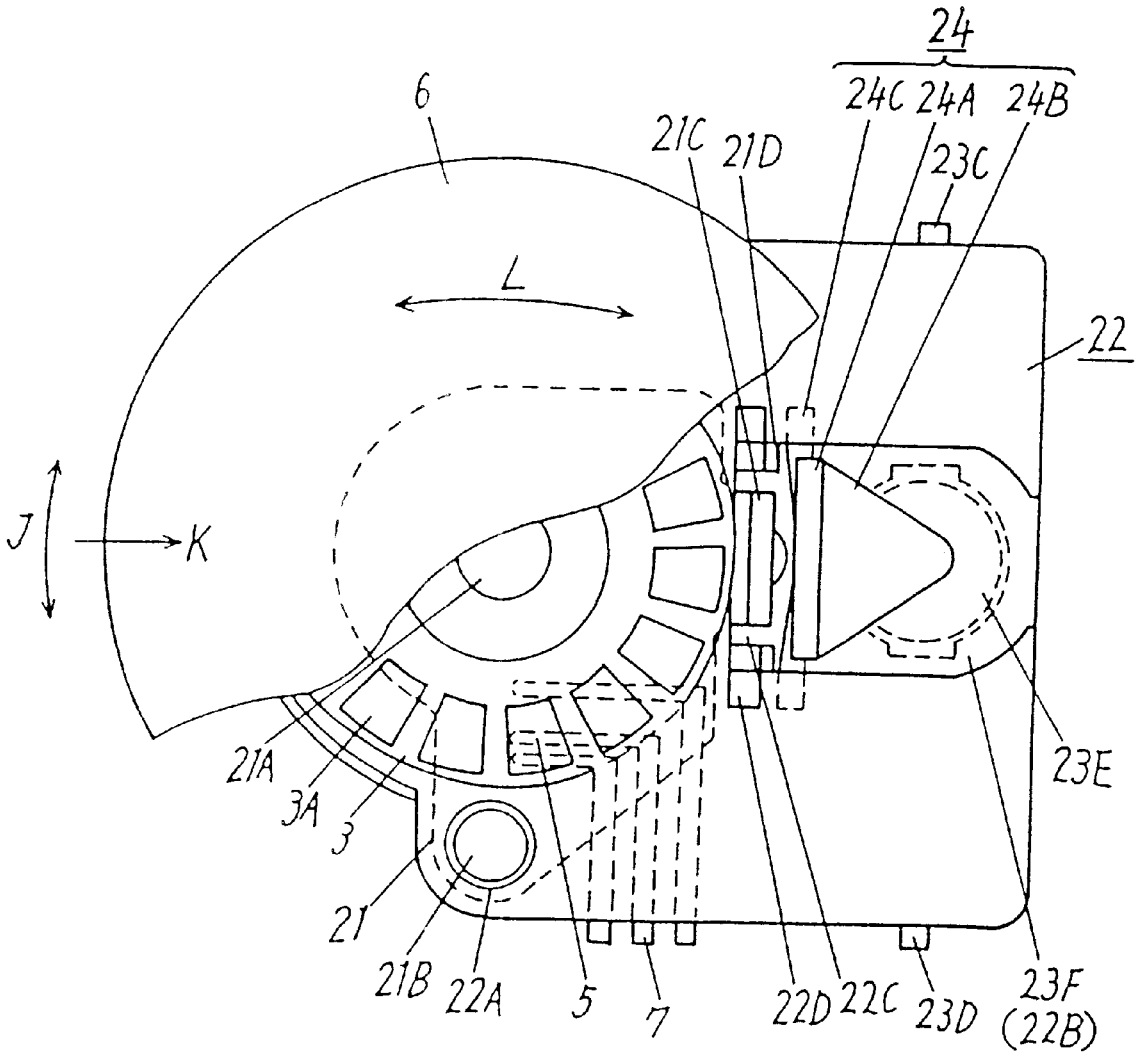

As shown in FIG. 1 and FIG. 2, a rotary encoder having built-in push switch according to the present invention comprises a movable member 21 affixed movable to a base board 22 at holding part 21B, a rotary contact wheel 3 affixed revolvable on the movable member 21 and disposed at the middle part of the base board 22, and a switch 23 disposed at a rear part of base board 22 (at the right in FIGS. 1–2). This constitution is similar to that of the prior art.

The rotary contact wheel 3 is provided at the bottom surface with contact plates 3A disposed in a radial arrangement for accepting the contact from elastic contact reeds 5 of the base board 22, and held revolvable at the central hole 3B by a pillar 21A of the movable member 21 with the top covered with an operating knob 6 that rotates together. This constitution is similar to that of the prior art, too.

Figure 3:
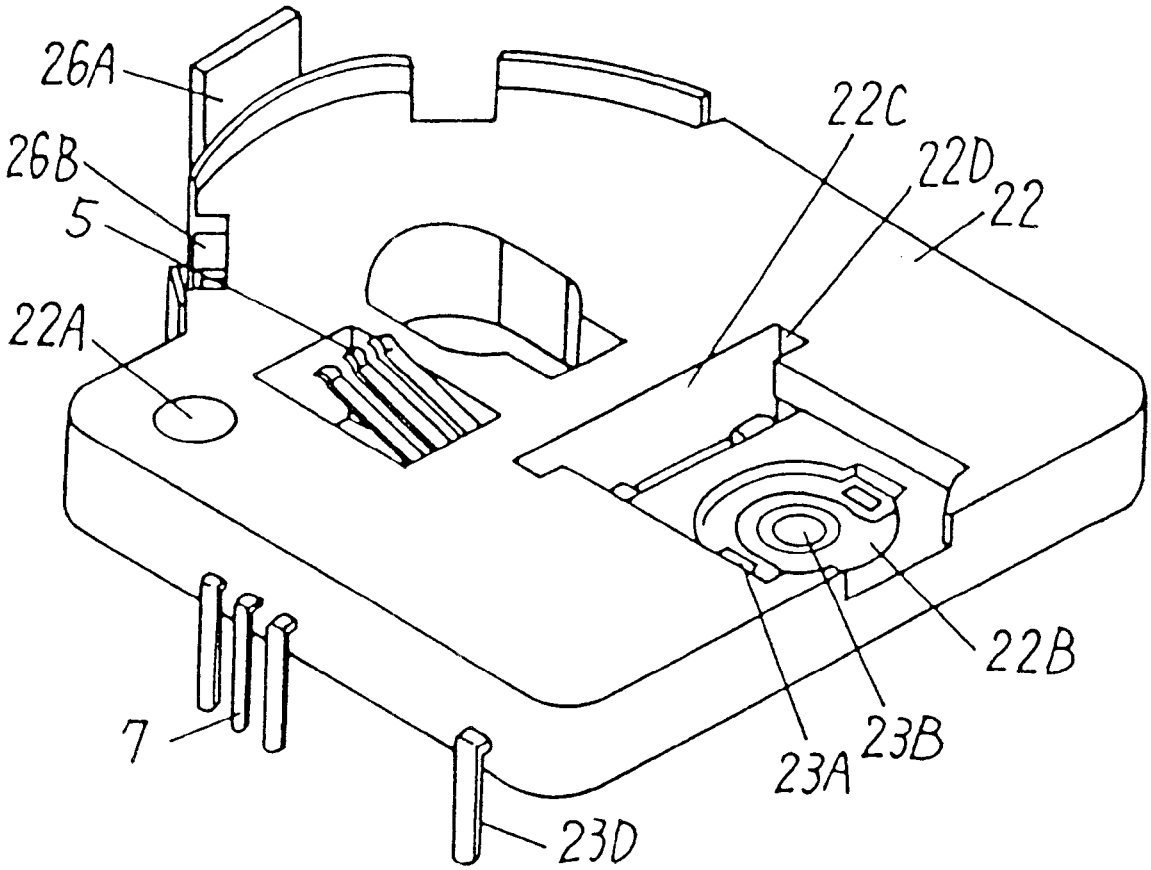
Figure 4:
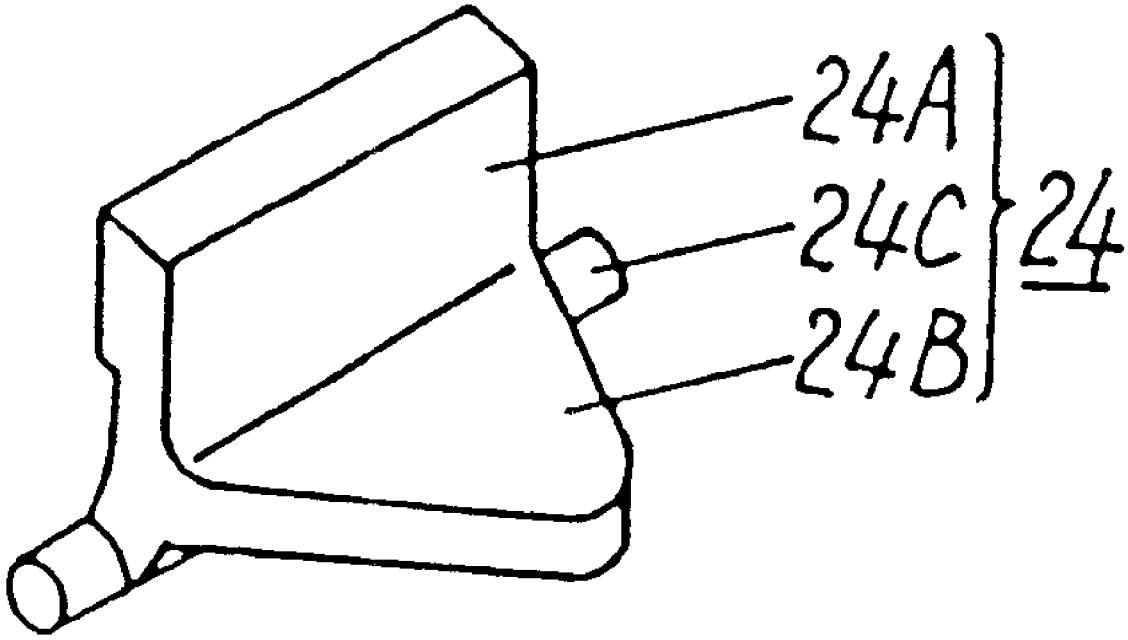
Figure 5:
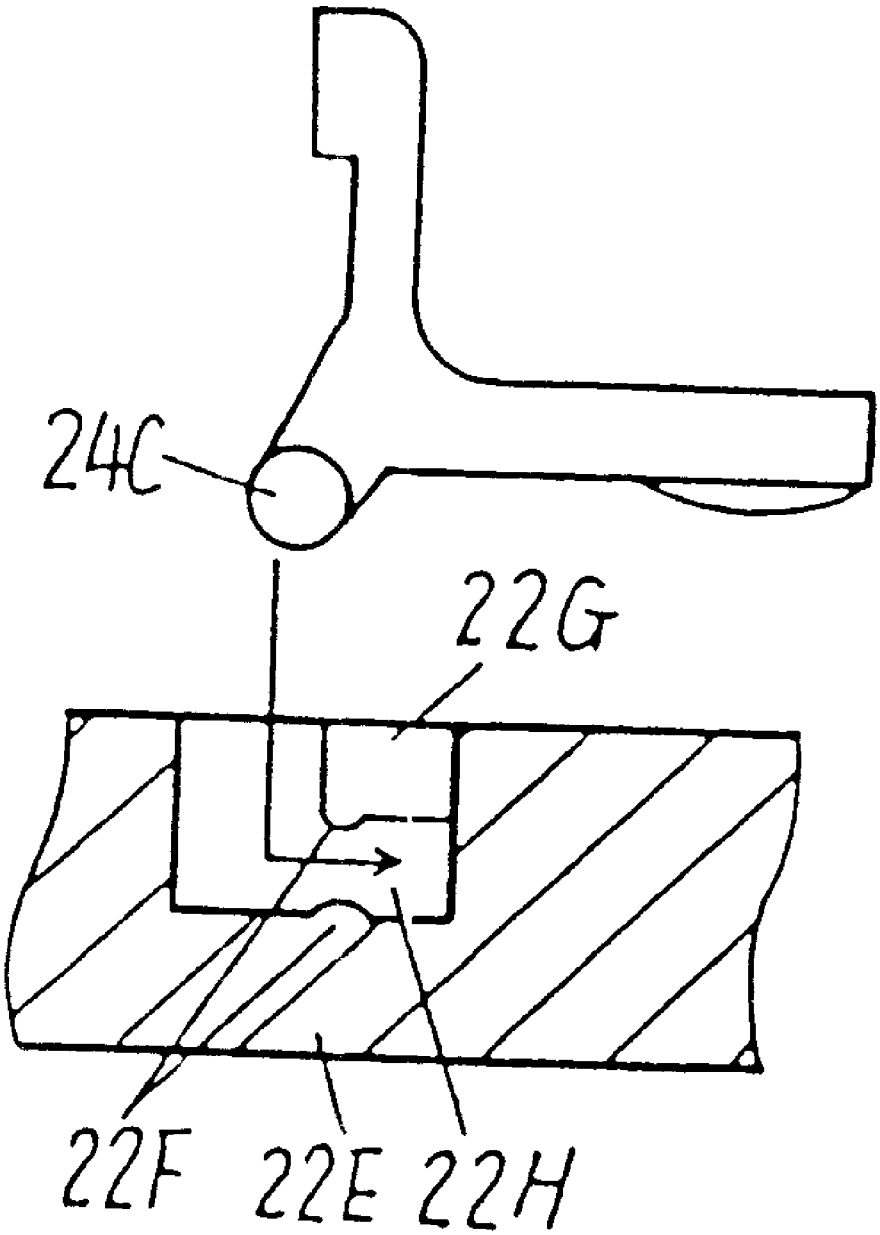

As shown in perspective view of FIG. 3. the base board 22 comprises a hole 22A for holding the movable member 21 movable, elastic contact reeds 5 for generating electric signal by having contact with the bottom surface of rotary contact wheel 3, and terminals 7 for taking the generated electric signal out. Within a hollow 22B of the base board 22, a pair of fixed contact points 23A and 23B for switch 23 are provided, and switch terminals 23C and 23D electrically coupled respectively with these contact points at an outer circumferential part. A pit 22C for affixing the L-shaped actuator 24 is provided in a central part of base board 22 at an outskirt of the hollow 22B. The L-shaped actuator 24 for actuating the switch 23 is comprised of arms of board form 24A and 24B, approximately rectangular to each other, and a holding pivot 24C located at the crossing part, as shown in FIG. 4.

A method of assembling a rotary encoder having built-in push switch according to the present embodiment is described in the following. A domed movable contact point 23E is attached on the outer fixed contact point 23A disposed in the hollow 22B located at a rear part of base board 22, covering the inner fixed contact point 23B, and then a flexible film 23F for dust-free is applied over the domed movable contact point to complete a switch 23.

The L-shaped actuator is affixed in the pit 22C of base board 22 in the following method. The holding pivot 24C is pushed into the pit 22C of base board 22 at the enlarged part 22D (see FIG. 2 and FIG. 3) with the arm 24A of L-shaped actuator 24 perpendicular to the base board 22, and the arm 24B facing to switch 23, upon reaching the floor 22E of pit the holding pivot 24C is made to go horizontally in order to bring the entire body of L-shaped actuator 24 towards the switch 23. The holding pivot 24C goes beyond a small bump 22F to be fixed into a cavity 22H formed by the pit floor 22E and a ceiling wall 22G, as shown with an arrow line in FIG. 5. In this way the L-shaped actuator 24 is held movable with the holding pivot 24C as the axis. The bottom surface of arm 24B keeps touching with the top of the domed movable contact 23E of said switch 23 via the flexible film 23F.

The movable member 21 is coupled with the base board 22 by inserting the holding part 21B of movable member 21 provided at an end into a hole 22A from underneath which is provided in the base board 22 at an end, then an extrusion 21D at the end of an arm 21C located in a rear end of the movable member 21 will touch to an end of arm 24A of said L-shaped actuator 24. The rotary contact wheel 3 is attached revolvable to the movable member 21 at pillar 21A, and then the operating knob 6 is mounted to complete a rotary encoder with built-in push switch according to the present embodiment.

Now in the following, the operation of a rotary encoder with built-in push switch according to the present embodiment is described.

Pulse signals are generated by rotating the operating knob 6 with a force given in the tangential direction as indicated with an arrow J in FIG. 2; by the rotation of rotary contact wheel 3 with the pillar 21A of movable member 21 as the center of rotation the radial contact plates 3A disposed on the bottom surface of rotary contact wheel 3 slide on the elastic contact reeds 5 of base board 22 to generate the pulse signals. The pulse signals are led to the outside through the terminals 7 providing a function as a rotary encoder. This operation is similar to that in the prior art.

During the above rotating operation of knob 6. although an element of the force given to the knob in the push-in direction, or the force given to the movable member 21, reaches the domed movable contact point 23E of switch 23 via the arm 21C of movable member 21 and the L-shaped actuator 24, the switch 23 is not put into operation because the elastic force of domed movable contact 23E is set to be strong enough to resist the element of force.

Figure 6:
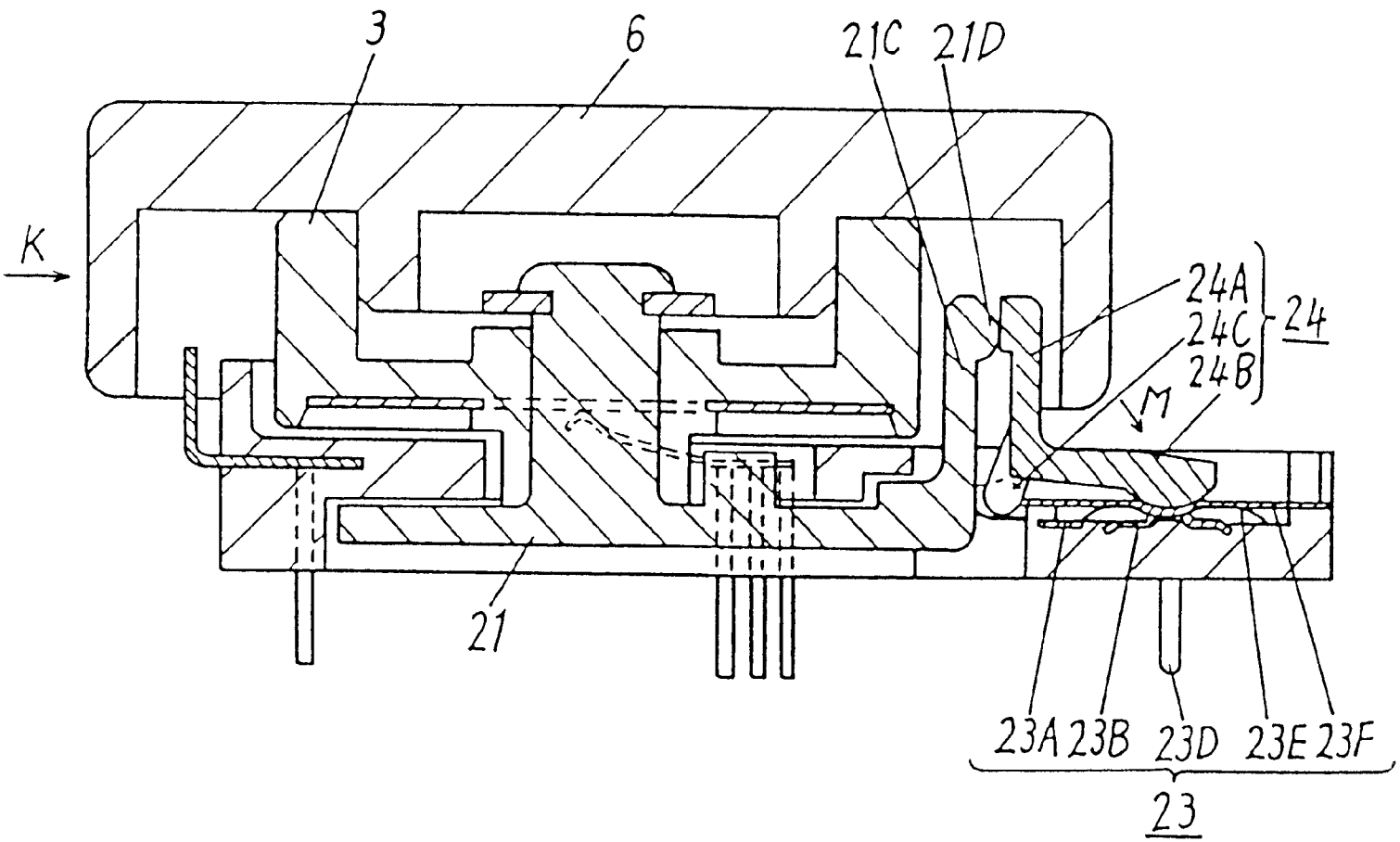

When the operating knob 6 is pressed in the direction as indicated by an arrow K in FIG. 2 and FIG. 6 with a force strong enough to overcome the force due to the elastic force of said domed movable contact 23E of switch 23, the rotary contact wheel 3 and the entire movable member 21 move to the direction as indicated by an arrow L with the holding part 21B of movable member 21, viz. the hole 22A of base board 22, as the axis. Then, the extrusion 21D provided at the end of arm 21C of movable member 21 pushes the end of arm 24A of L-shaped actuator 24 making the L-shaped actuator 24 rotate in the direction shown by an arrow M in FIG. 6 around the holding pivot 24C. The end tip of arm 24B pushes the top of the domed movable contact point 23E of switch 23 firmly downward. As the result, the domed movable contact point 23E is reversed with snapping action, and the fixed contact point 23A and the fixed contact point 23B, or the switch terminals 23C and 23D, are shortcircuited as shown in FIG. 6.

As soon as the push-in force given to the knob 6 is withdrawn, the arm 24B of L-shaped actuator 24 is pushed up by the elastic restoring force of the domed movable contact point 23E, and movable member 21, rotary contact wheel 3, and knob 6 are pushed back to the original position as shown in FIG. 1 and FIG. 2.

The force needed to push the knob 6 in depends on the elastic restoring force of the domed movable contact point 23E, and the relationship between the push-in force and the push-in stroke of the knob 6 are adjustable through adjustment of the location at which the arm 21C of movable member 21 presses the arm 24A of L-shaped actuator 24, and the location at which the arm 24B presses the domed movable contact point 23E of switch 23. When the arm 21C is provided at a rear end of movable member 21 and the extrusion 21D at the end of the arm is made to press the extreme end of arm 24A of L-shaped actuator 24, as in the present embodiment, the push-in stroke becomes the largest.

Figure 7:
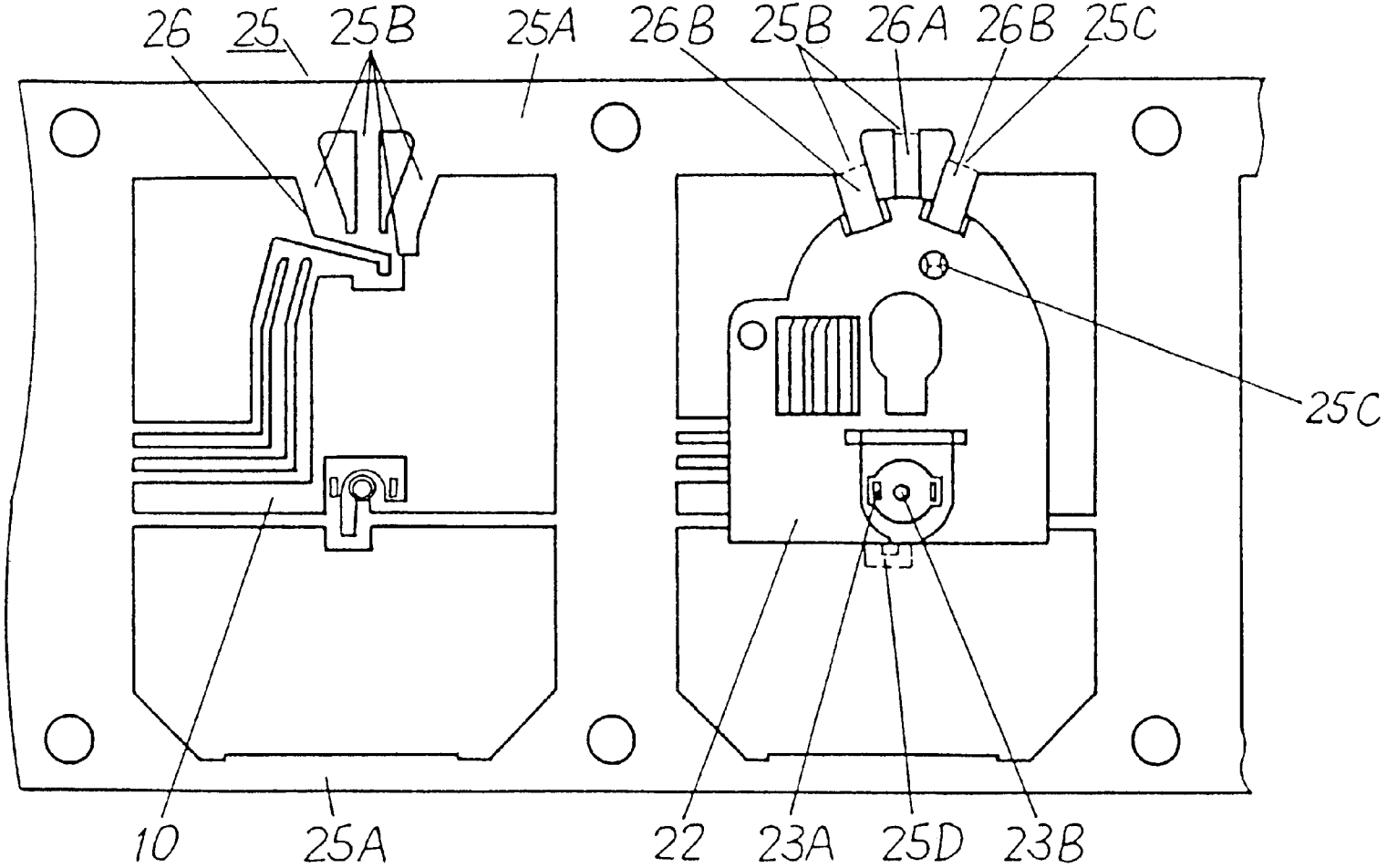

A method of manufacturing the base board 22 according to the present invention is shown in FIG. 7. Where, numeral 25 denotes a hoop of electro-conductive metal sheet on which a gathering of the conductive members 10 and the grounding part 26 as well as the fixed contact points 23A and 23B for switch tied with the frame 25A and the conductive members 10 by means of the connecting sections 25B is continually stamped. Numeral 22 denotes a resin-molded base board in which the conductive members 10, the grounding part 26, and the fixed contact points 23A and 23B for switch are inserted.

In the base board 22 thus formed, the conductive members 10, the elastic contact reeds 5, and the terminals 7 are shaped in the same way as in the prior art. And then, the connecting sections 25B of the grounding part 26 are cut at the cutting places 25C; of which a plate 26A to work as a lightning rod is bent upward, while plates 26B to become grounding terminals are bent downward, and the fixed contact points 23A and 23B for the switch are separated by cutting the cutting section 25D; and a base board 22 as shown in FIG. 3 is completed.

Figure 8:
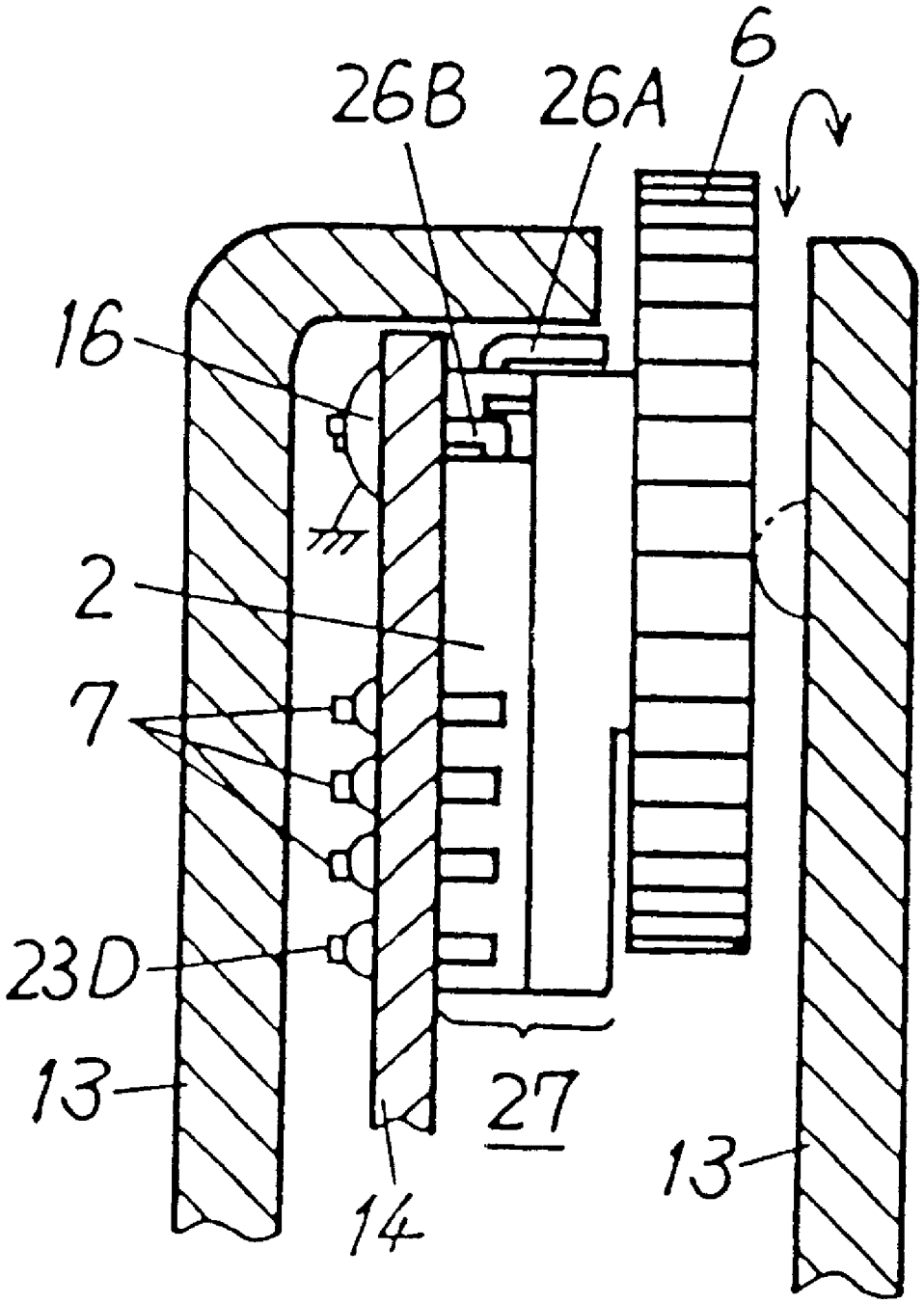
Figure 9:
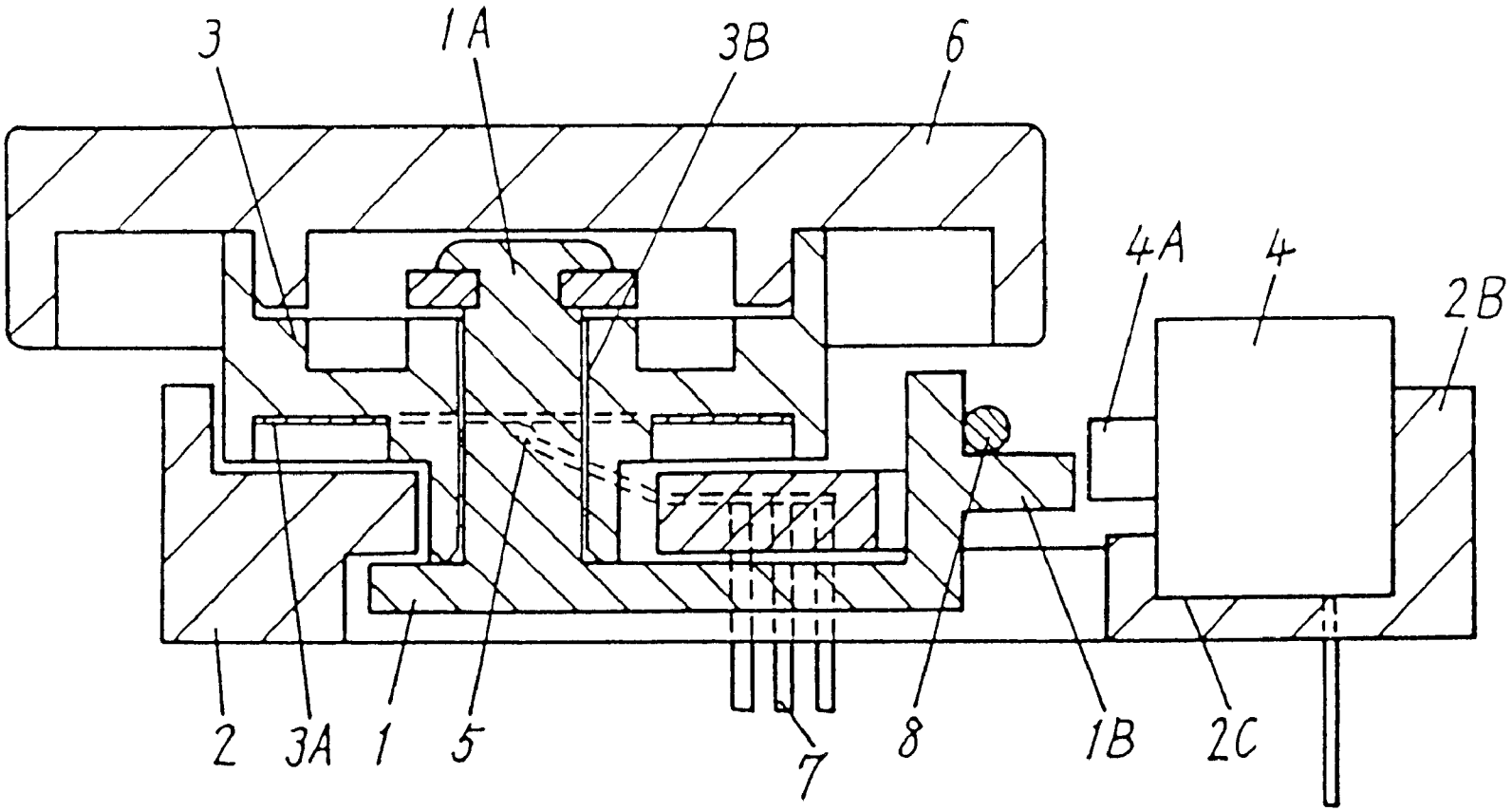
FIG. 9 PRIOR ART
FIG. 9 is a cross sectional view showing a prior art rotary encoder having push switch, FIG. 10 a partially cutaway top view of the above rotary encoder, FIG. 11 a perspective view of the key part of the above rotary encoder, viz. the base board, FIG. 12 a top view of prior art metal sheet hoop showing the conductive members formed on the hoop and these members after insert-molded in a resin mold base board, FIG. 13 a cross sectional side view of the above rotary encoder having push switch mounted in a casing.
Figure 10:
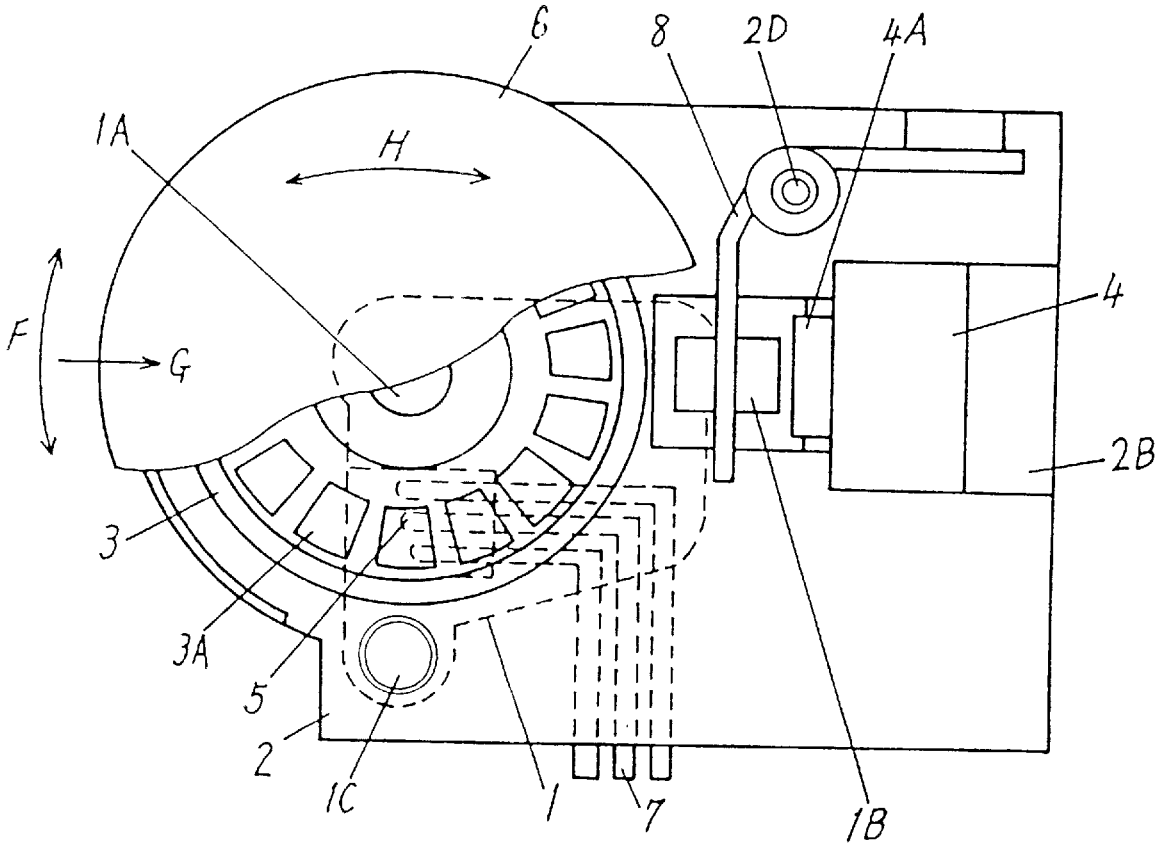
FIG. 10 PRIOR ART
Figure 11:
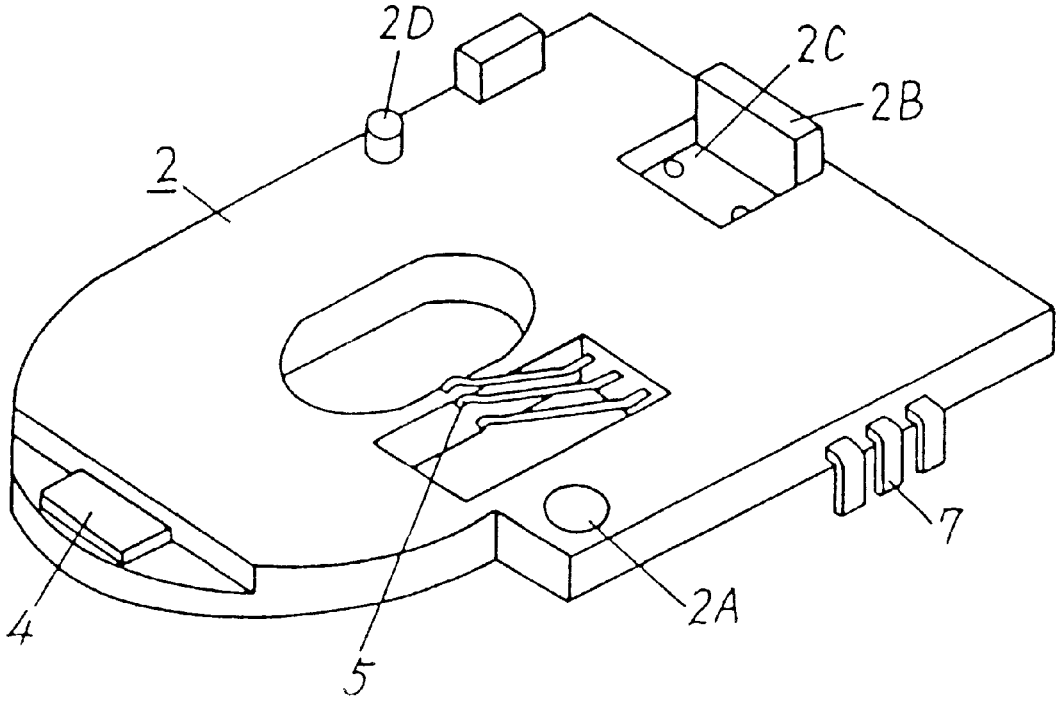
FIG. 11 PRIOR ART
Figure 12:
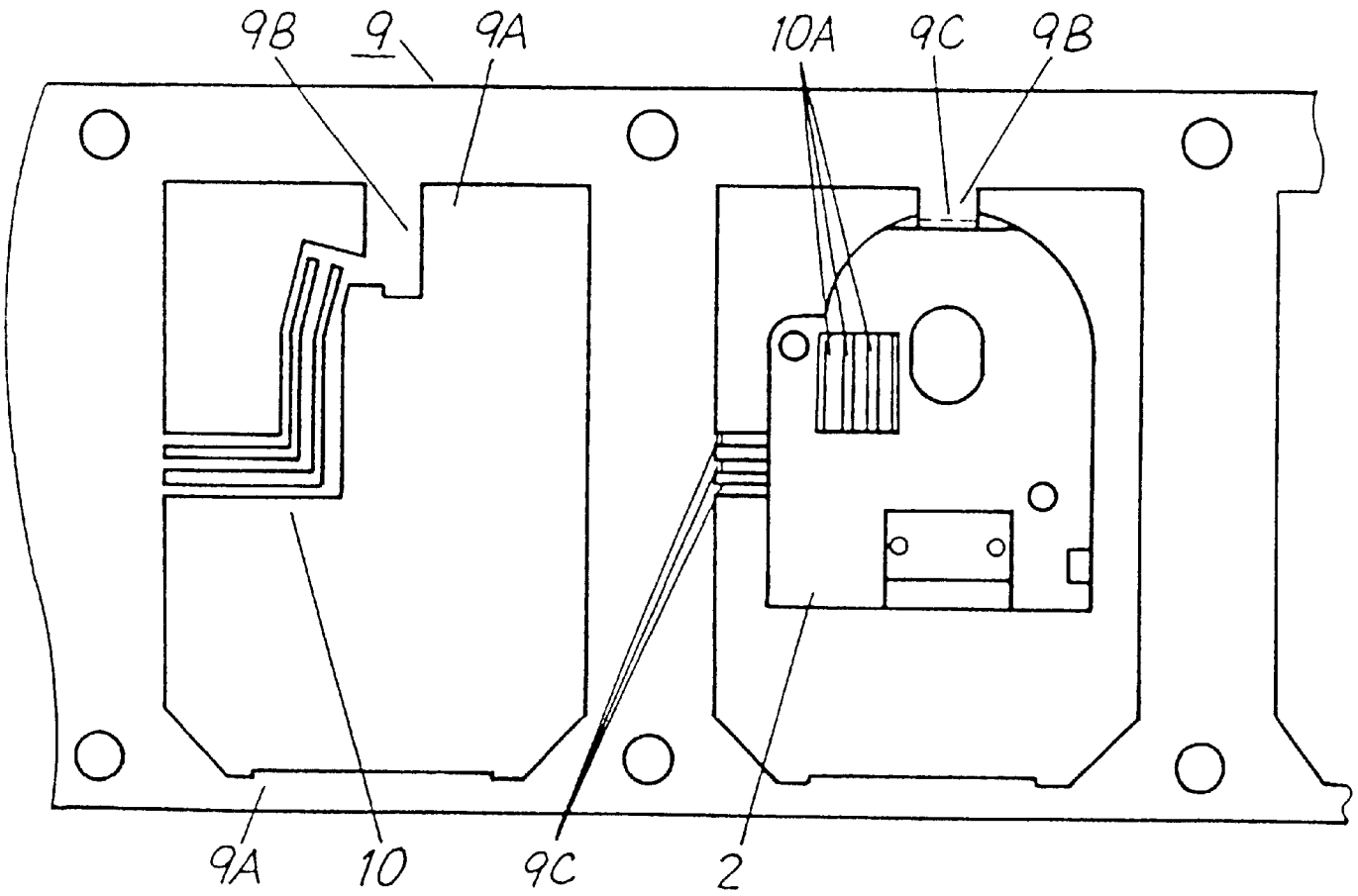
FIG. 12 PRIOR ART
Figure 13:
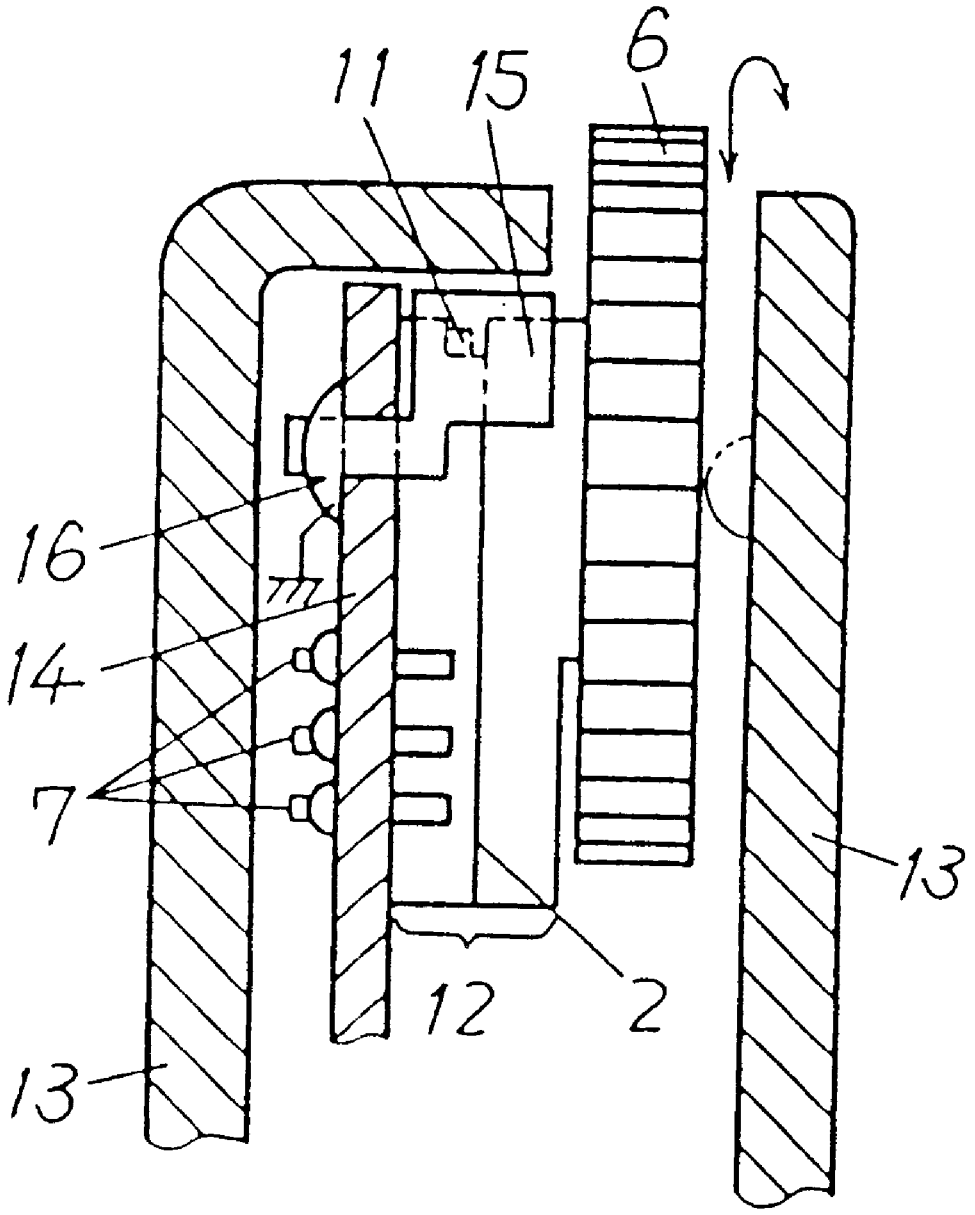
FIG. 13 PRIOR ART

A rotary encoder with built-in push switch made with the base board 22 is mounted on an apparatus as shown in FIG. 8, where the grounding terminals 26B are electrically coupled with a circuit board 14 of the apparatus at the ground sector 16, furthermore the grounding part 26 is located at a place closest to the outer surface of apparatus casing 13. By so mounting, the lightning rod 26A of grounding part 26 becomes an electro-conductive substance located closest to the operating knob 6, therefore the static electricity always jumps onto the lightning rod 26A and escapes to the grounding wire through the grounding terminals 26B. Thus the grounding is ensured without providing the metal board 15, which was indispensable with the prior arts.

In FIG. 3 and FIG. 8 both describe the present embodiment, the plate to become lightning rod 26A of grounding part 26 is bent upward, while the plates to become the grounding terminals 26B downward; however, it is of course possible to dispose the plates for lightning rods 26A up in the right and left, whereas the plate for grounding terminal 26B down in the middle.

Furthermore, according to the present constitution, as the output terminals 7, the grounding terminals 26B, and the switch terminals 23C/23D are taken out to be formed and disposed in a same direction with almost equivalent dimensions, while the grounding part is built in a rotary encoder having push switch, the accuracy of terminal arrangement is high enough to undergo the automatic assembly, which enables to further reduce the number of steps for assembling an apparatus.

In the above embodiment, descriptions have been made using a rotary encoder having built-in push switch, which being an embodiment of the operation type electronic component, as the vehicle. However, it is of course possible to apply the above base board manufacturing method to the manufacture of normal operation type electronic components having no push switch.

USABILITY IN THE INDUSTRY

According to the present invention, a switch is constituted with fixed contact points provided on the base board of an operation type electronic component and a dome shaped movable contact point placed over the fixed contact points, and an L-shaped actuator is disposed between the switch and a movable member having an operating knob; thereby the movable member is prevented from putting the switch into operation during rotating operation of the knob by making use of the elastic force of the dome shaped movable contact point of switch, meanwhile the same elastic force is utilized for returning the movable member to the original position as soon as the push-in operation of knob is over. The conductive members and the grounding parts stamped in a same metal sheet are once fixed in a resin molded base board by means of an insert-molding method, and then electrically separated afterwards; this brings about a grounding part positioned between the conductive members and the operating knob.

By taking the above described constitution, the total number of constituent components including those of the switch are reduced enabling to reduce the cost and the overall size of an operation type electronic component. Furthermore, by simply mounting a base board prepared through the above method on a circuit board of an apparatus an operation type electronic component is presented, wherein the static electricity generated from operating knob always escapes to the grounding part which is an electro-conductive substance located closest to the knob.

We claim:

1. An electronic component comprising:

a resin mold body in which a conductive member comprised of a contact point and a terminal is housed;

an operating knob for switching an electrical signal to be generated at said conductive member by operating an outer circumference portion of said operating knob; and a grounding electro-conductive substance for removing static electricity generated in the operating knob, insert-molded within said resin mold body so as to be positioned near the outer circumference portion of said operating knob between the outer circumference portion of said operating knob and said conductive member.

2. The electronic component of claim 1, wherein said conductive member and said grounding electro-conductive substance are formed on a common metal material to be insert-molded in said resin mold body, and then said conductive member and said grounding electro-conductive substance are electrically separated after being molded in said resin mold body.

3. The electronic component of claim 2, wherein said terminal of said conductive member and a terminal of said grounding electro-conductive substance extend out of the resin mold body in a common directional arrangement at approximately a common length.

4. The electronic component of claim 1, wherein said terminal of said conductive member and a terminal of said grounding electro-conductive substance extend out of the resin mold body in a common directional arrangement at approximately a common length.

5. The electronic component of claim 1, wherein said grounding electro-conductive substance includes a lightning rod terminal extending upward from an upper main surface of said resin mold body, and a grounding terminal extending downward from a lower main surface of said resin mold body.

6. An electronic component comprising:

a rotary contact wheel having an operating knob and a plurality of contact elements;

a resin mold body in which a conductive member is molded, said resin mold body having an upper main surface and a lower main surface, and said conductive member including an elastic reed for generating an electrical signal by elastically contacting with a contact element of said rotary contact wheel and a terminal for taking said electrical signal out;

a movable member which holds said rotary contact wheel removable and is coupled with said resin mold body part so as to be movable in parallel with said upper main surface of the resin mold body;

a switch comprised of a fixed contact point molded at an end part of said resin mold body and a dome shaped movable contact point placed over the fixed contact point;

an L-shaped actuator for activating said switch and including a first arm perpendicular to the main surface of said resin mold body and touching an edge of said movable member, a second arm extending perpendicular from said first arm, parallel with the main surface of said resin mold body, towards said switch and contacting the dome shaped movable contact point of the switch, and a pivot for revolvably attaching said L-shaped actuator to said resin mold body, said pivot being positioned adjacent where said first and second arms meet; and a grounding electroconductive substance insert-molded within said resin mold body and positioned between an outer circumference of said operating knob and said conductive member, said grounding electro-conductive substance including a lightning rod terminal extending upward from and perpendicular to said upper main surface of said resin mold body, and a grounding terminal extending downward from and perpendicular to said lower main surface.

7. An electronic component comprising:

a rotary contact wheel having an operating knob and a plurality of contact points;

a resin mold body in which a conductive member is molded, said conductive member including an elastic reed and a terminal for taking an electrical signal out, the electrical signal being generated when the elastic reed elastically contacts with a contact point of said rotary contact wheel;

a movable member which holds said rotary contact wheel revolvable and is coupled with said resin mold body so as to be movable in parallel with a main surface of the resin mold body;

a switch comprised of a fixed contact point molded at an end part of said resin mold body and a dome shaped movable contact point placed over the fixed contact point;

an L-shaped actuator for actuating said switch and including a first arm perpendicular to the main surface of said resin mold body and touching an edge of said movable member, a second arm extending perpendicular from said first arm, parallel with the main surface of said resin mold body, towards said switch and contacting the dome shaped movable contact point of the switch, and a pivot for revolvably attaching said L-shaped actuator to said resin mold body, said pivot being positioned adjacent where said first and second arms meet; and a grounding electro-conductive substance for removing static electricity generated in the operating knob, insert-molded within said resin mold body so as to be positioned near an outer circumference portion of said operating knob between the outer circumference of said operating knob and said conductive member.

8. The electronic component of claim 7, wherein an extrusion is provided at a certain part of an outer circumference of said movable member for contacting with said first arm at an end point of said L-shaped actuator.

9. The electronic component of claim 8, wherein said L-shaped actuator is attached to the resin mold body by first inserting said pivot vertically into a pit provided in said resin mold body and then lightly pushing in a horizontal direction towards said switch.

10. The electronic component of claim 7, wherein said L-shaped actuator is attached to the resin mold body by first inserting said pivot vertically into a pit provided in said resin mold body and then lightly pushing in a horizontal direction towards said switch.

* * * * *